US005260253A

United States Patent [19]

Kawakami et al.

[11] Patent Number: 5,260,253

[45] Date of Patent: Nov. 9, 1993

[54] HEAT-SENSITIVE RECORDING MATERIAL

[75] Inventors: Hiroshi Kawakami; Ken Iwakura, both of Shizuoka, Japan

[73] Assignee: Fuji Photo Film Co., Ltd., Kanagawa, Japan

[21] Appl. No.: 906,474

[22] Filed: Jun. 30, 1992

[30] Foreign Application Priority Data

Jul. 5, 1991 [JP] Japan ..... 3-165743

[51] Int. Cl.[5] ..... B11M 5/28

[52] U.S. Cl. ..... 503/216; 503/209; 503/225

[58] Field of Search ..... 503/216, 225, 209

[56] References Cited

U.S. PATENT DOCUMENTS 4,507,670 3/1985 Motosugi et al. ..... 503/214
4,517,580 5/1985 Iiyama et al. ..... 503/214

OTHER PUBLICATIONS

Patent Abstracts of Japan, vol. 11, No. 377 (M-649) (2824) Dec. 9, 1987, for JP-A-62 149 479 (Ricoh K.K.) Jul. 3, 1987.

Patent Abstracts of Japan, vol. 9, No. 311 (M-436) (2034) Dec. 7, 1985, and JP-A-60 145 884 (Honshiyuu Seishi K.K.) Aug. 1, 1985.

Patent Abstracts of Japan, vol. 11, No. 90 (M-573) (2537) Mar. 20, 1987, for JP-A-61 242 890 (Ricoh K.K.) Oct. 29, 1986.

*Primary Examiner*—Pamela R. Schwartz
*Attorney, Agent, or Firm*—Sughrue, Mion, Zinn, Macpeak & Seas

[57] ABSTRACT

A heat-sensitive recording material comprising a support having thereon a heat-sensitive color forming layer comprising an electron-donating colorless dye and an electron-accepting compound, wherein said electron-accepting compound is a bisthiourea compound.

7 Claims, No Drawings

HEAT-SENSITIVE RECORDING MATERIAL

FIELD OF THE INVENTION

This invention relates to a heat-sensitive recording material, and more particularly to a heat-sensitive recording material which is improved in developability, shelf life stability before recording and the stability of developed color images.

BACKGROUND OF THE INVENTION

Recording materials using electron-donating colorless dyes and electron-accepting compounds are already well known as pressure-sensitive papers, heat-sensitive papers, light- and pressure-sensitive papers, electro- and heat-sensitive recording papers, heat-sensitive transfer papers, etc. For example, such recording materials are fully described in British Patent 2,140,449, U.S. Pat. Nos. 4,480,052 and 4,436,920, JP-B-60-23992 (corresponding to U.S. Pat. Nos. 4,181,328) the term "JP-B" as used herein means an "examined Japanese patent publication"), JP-A-57-179836 (the term "JP-A" as used herein means an "unexamined published Japanese patent application"), JP-A-60-123556 and JP-A-60-123557. Particularly, such heat-sensitive recording materials are described in detail in JP-B-43-4160 and JP-B-45-14039. These heat-sensitive recording systems are widely used in the fields of facsimiles, printers, labels, etc. and the practical needs therefor are continually increasing. However, these heat-sensitive recording materials have disadvantages in that fogging is caused by solvents, developed materials are discolored or faded by fats and oils, reagents, etc. Accordingly, the commercial values thereof have been greatly reduced in the fields of labels, slips, word processor paper, plotter paper, etc. in particular. The present inventors have sought to develop practically useful novel recording materials by paying attention to the oil solubility, solubility in water, partition coefficient, pKa, polarity of substituent groups and position of the substituent groups of each of the electron-donating colorless dye and the electron-accepting compound. It has been found, as a general rule, that developed materials which are scarcely fogged by solvents are apt to be faded by fats and oils, reagents, etc., while, on the other hand, developed materials which are scarcely faded by fats and oils, reagents, etc. are apt to be fogged by solvents.

The use of monothiourea compounds for the heat-sensitive recording material are already known in JP-A-59-190893, JP-A-59-176088, JP-A-133096, JP-A-136288 and JP-A-58-222887, but these heat-sensitive recording materials have disadvantages in that fogging and decoloration in the color formed area are caused.

SUMMARY OF THE INVENTION

An object of the present invention is to provide a heat-sensitive recording material which is highly sensitive, has good shelf life stability, gives a developed color image having good stability and enables printing of high quality to be conducted.

The above-described and other objects and advantages in accordance with the present invention have been achieved by providing a heat-sensitive recording material comprising a support having thereon a heat-sensitive color forming layer comprising an electron-donating colorless dye and an electron-accepting compound, wherein the electron-accepting compound is a bisthiourea compound.

DETAILED DESCRIPTION OF THE INVENTION

Now, the present invention will be illustrated in more detail below.

Among bisthiourea compounds which can be used in the present invention as an electron-accepting compound, bisthiourea compounds represented by the following formula (1) are preferred, and those represented by the following formula (2) are more preferred:

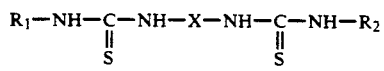

(1)

wherein $R_1$ and $R_2$ each independently represents an alkyl group or a substituted or unsubstituted aryl group, preferably a $C_1$ to $C_{12}$ alkyl group or a $C_6$ to $C_{10}$ aryl group; and X represents an alkylene group, an aralkylene group or an arylene group, preferably a $C_2$ to $C_{18}$ alkylene, $C_2$ to $C_{18}$ aralkylene or $C_2$ to $C_{18}$ arylene group which may have an ether linkage;

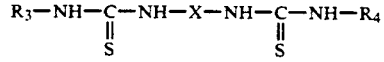

(2)

wherein $R_3$ and $R_4$ each independently represents a substituted or unsubstituted aryl group, preferably a $C_6$ to $C_{10}$ aryl group; and X represents an alkylene group, an aralkylene group or an arylene group, preferably a $C_2$ to $C_{18}$ alkylene, $C_2$ to $C_{18}$ aralkylene or $C_2$ to $C_{18}$ arylene group which may have an ether linkage.

The aryl group represented by $R_1$ to $R_4$ in formulae (1) and (2) may have one or more substituent groups. Examples of suitable substituent groups include an alkyl group, an alkoxy group, a halogen atom, a trihalomethyl group, a cyano group, an acyl group, an aryl group, an alkylsulfonyl group and an arylsulfonyl group, preferably a $C_1$ to $C_4$ alkyl group, a $C_1$ to $C_4$ alkoxy group, a $C_6$ to $C_{10}$ aryl group, a trihalomethyl group and a halogen atom.

Typical examples of suitable bisthiourea compounds within formulae (1) and (2) include the following compounds.

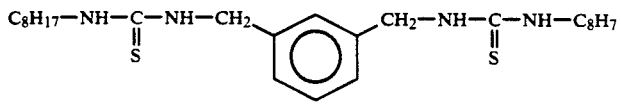

Compound 1

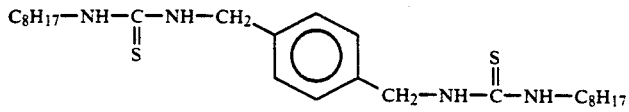

Compound 2

-continued
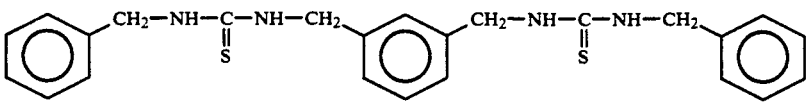
Compound 3
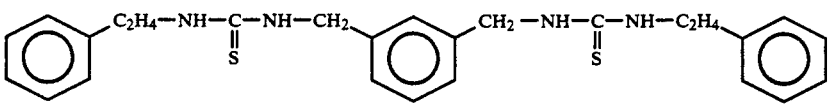
Compound 4
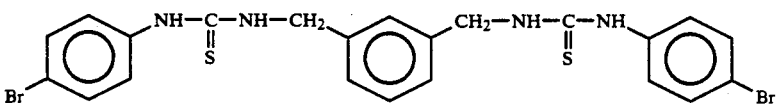
Compound 5
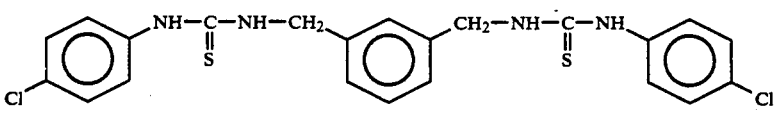
Compound 6
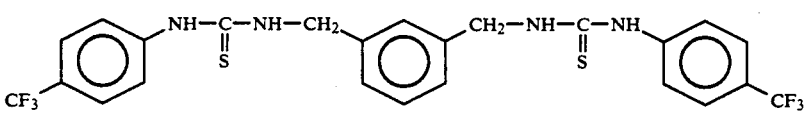
Compound 7
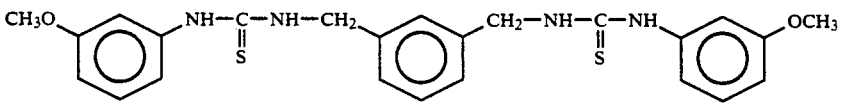
Compound 8
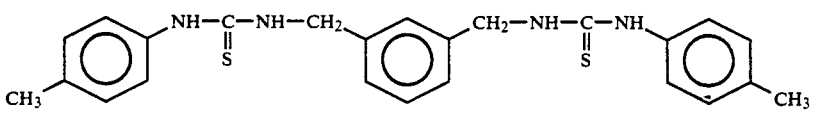
Compound 9
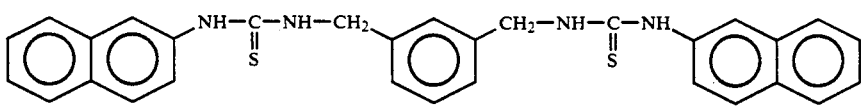
Compound 10
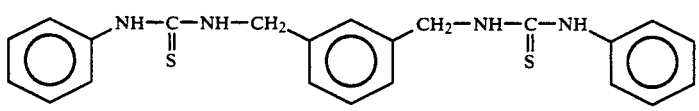
Compound 11
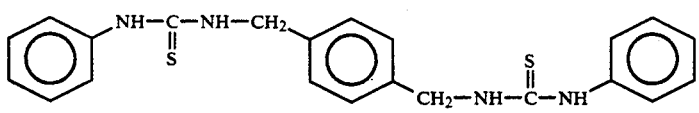
Compound 12
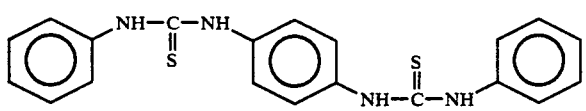
Compound 13
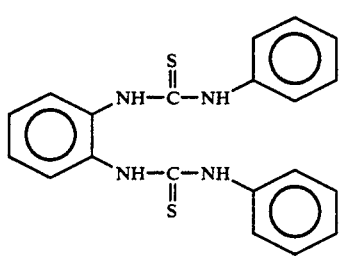
Compound 14

-continued
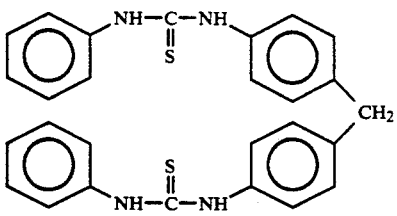
Compound 15
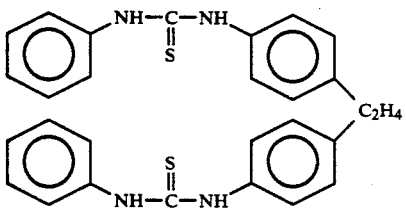
Compound 16
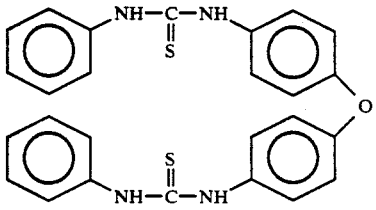
Compound 17
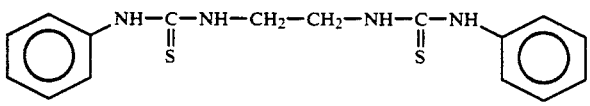
Compound 18
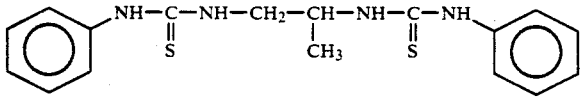
Compound 19
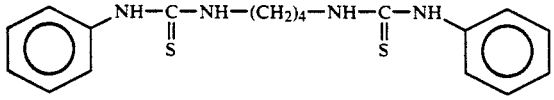
Compound 20
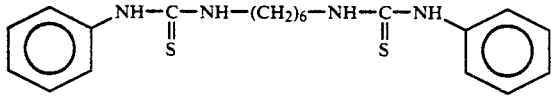
Compound 21
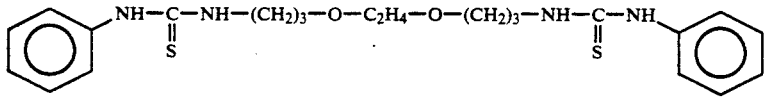
Compound 22
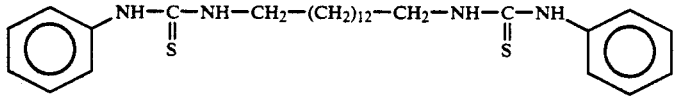
Compound 23
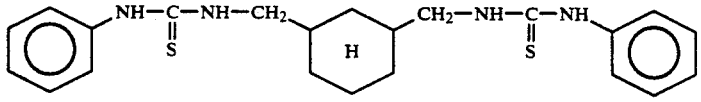
Compound 24
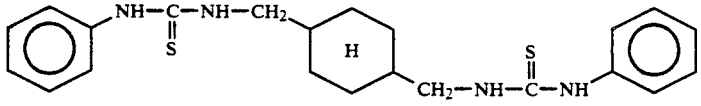
Compound 25

The bisthiourea compounds of formulae (1) and (2) may be used either alone or in a combination of two or more of them. The bisthiourea compounds may be used together in the color forming layer with conventional electron-accepting compounds such as phenol derivatives, phenolic resins, novolak resins, metal-treated novolak resins, metal complexes, salicylic acid derivatives, metal salts of aromatic carboxylic acids, acid clay and bentonite. Examples of these compounds are described, for example, in JP-B-40-9309, JP-B-45-14039, JP-A-52-140483 (corresponding to U.S. Pat. No. 4,138,357), JP-A-48-51510, JP-A-57-210886, JP-A-58-87089, JP-A-59-11286, JP-A-60-176795 and JP-A-61-95988. Specific examples of these compounds include 4-tert-butylphenol, 4-phenylphenol, 2,2'-dihydroxybiphenyl, 2,2-bis(4-hydroxyphenyl)propane (bisphenol A), 4,4'-sec-butylidenediphenol, 4,4-cyclohexylidenediphenol, bis(3-aryl-4-hydroxyphenyl)sulfone, 4-hydroxyphenyl-3',4'-dimethylphenylsulfone, 4-(4-isopropoxyphenylsulfonyl)-phenol, 4,4'-dihydroxydiphenyl sulfide, 1,4-bis(4-hydroxycumyl)benzene, 1,3-bis(4'-hydroxycumyl-benzene,4,4'-thiobis(6-tert-butyl-3-methylphenol), 1,1,3-tris (2-methyl-4-hydroxy-5-tert-butylphenyl)butane, 4,4'-butylidene-bis(3-methyl-6-tert-butylphenol), 4,4'-dihydroxydiphenylsulfone, benzyl 4-hydroxybenzoate, 3,5-di-tert-butylsalicylic acid, 3-phenyl-5-(α,α-dimethylbenzyl)-salicylic acid, 3-cumyl-5-t-octylsalicylic acid, 3,5-di-t-butylsalicylic acid, 3-phenyl-5-t-octylsalicylic acid, 3-methyl-5-α-methylbenzylsalicylic acid, 3-methyl-5-cumylsalicylic acid, 3,5-di-t-octylsalicylic acid, 3,5-bis(α-methylbenzyl)salicylic acid, 3-cumyl-5-phenylsalicylic acid, 5-n-octadecylsalicylic acid, 4-pentadecylsalicylic acid, 3,5-bis(α,α-dimethylbenzyl)salicylic acid, 3,5-bis-t-octylsalicylic acid, 4-β-dodecyloxyethoxysalicylic acid, 4-methoxy-6-dodecyloxysalicylic acid, 4-β-phenoxyethoxysalicylic acid, 4-β-p-ethylphenoxyethoxysalicylic acid, 4-β-p-methoxyphenoxyethoxysalicylic acid and their metal salts.

The bisthiourea compound which is the electron-accepting compound of the present invention is preferably used in an amount of 20 to 500% by weight, more preferably 50 to 300% by weight, based on the weight of the electron-donating colorless dye. It is preferred that 10 to 100% by weight of the above-described conventional electron-accepting compound is mixed with the bisthiourea compound according to the present invention. The above-described conventional electron-accepting compounds may be used either alone or in a combination of two or more of them. It is preferred from the viewpoint of obtaining color formation sensitivity that the bisthiourea compound(s) is finely divided in a mill into particles having a particle size of not larger than 3 μm, preferably not larger than 2 mμ.

Examples of the electron-donating colorless dyes which can be used in the present invention include triphenylmethanephthalide compounds, fluoran compounds, phenothiazine compounds, indolylphthalide compounds, Leuco Auramine compounds, Rhodamine lactam compounds, triphenylmethane compounds, triazene compounds, spiro-pyran compounds and fluorene compounds. Examples of the phthalide compounds are described in U.S. Reissue Pat. No. 23,024, U.S. Pat. Nos. 3,491,111, 3,491,112, 3,491,116 and 3,509,174. Examples of the fluoran compounds are described, for example, in U.S. Pat. Nos. 3,624,107, 3,627,787, 3,641,011, 3,462,828, 3,681,390, 3,920,510 and 3,959,571. Examples of spiro-pyran compounds are described in U.S. Pat. No. 3,791,808. Examples of pyridine and pyrazine compounds are described, for example, in U.S. Pat. Nos. 3,775,424, 3,853,869 and 4,246,318. Examples of the fluorene compounds are described, for example, in JP-A-63-94878. Among them, black color forming 2-arylamino-3-H- or halogen-, alkyl- or alkoxy-6-substituted aminofluoran compounds are particularly effective. Specific examples thereof include 2-anilino-3-methyl-6-diethylaminofluoran, 2-anilino-3-methyl-6-N-cyclohexyl-N-methylaminofluoran, 2-p-chloroanilino-3-methyl-6-dibutylaminofluoran, 2-anilino-3 -chloro-6-diethylaminofluoran, 2-anilino-3-methyl-6N-ethyl-N-isoamylaminofluoran, 2-anilino-3-methyl-6-N-ethyl-N-dodecylaminofluoran, 2-anilino-3-methoxy-6-dibutylaminofluoran, 2-o-chloroanilino-6-dibutylaminofluoran, 2-anilino-3-pentadecyl-6-diethylaminofluoran, 2-anilino-3-ethyl-6-dibutylaminofluoran, 2-o-toluidino-3-methyl-6-diisopropylaminofluoran, 2-anilino-3-methyl-6-N-isobutyl-N-ethylaminofluoran, 2-anilino-3-methyl-6-N-ethyl-N-tetrahydrofurfurylaminofluoran, 2-anilino-3-chloro-6-N-ethyl-N-isoamylaminofluoran, 2-anilino-3-methyl-6-N-methyl-N-γ-ethoxypropylaminofluoran, 2-anilino-3-methyl-6-N-ethyl-N-γ-ethoxypropylaminofluoran, 2-anilino-3-methyl-6-N-ethyl-N-γ-propoxypropylaminofluoran and 2-anilino-3-methyl-6-N-methyl-N-propylaminofluoran.

The electron-donating colorless dye is preferably coated in the color-forming layer in an amount of 0.1 to 2 g/m$^2$.

Sensitizing agents which can be used in the present invention include compounds described in JP-A-58-57989 (corresponding to U.S. Pat. No. 4,480,052), JP-A-58-87094 (corresponding to U.S. Pat. No. 4,471,074) and JP-A-63-39375. Typical examples of the sensitizing agents include aromatic ethers (particularly, benzyl ethers and di(substituted phenoxy)alkanes), aromatic esters, aliphatic amides, and ureas, and aromatic amides and ureas.

Typical examples of methods for preparing the heat-sensitive color forming layer of the present invention will be illustrated below.

The electron-donating colorless dye, the electron-accepting compound and the sensitizing agent are finely dispersed in an aqueous solution of a water-soluble polymeric material such as polyvinyl alcohol in a ball mill or a sand mill into a fine dispersion of several microns or finer. The sensitizing agent may be added to either one or both of the electron-donating colorless dye and the electron-accepting compound, and they may be simultaneously dispersed. If desired, an eutectic mixture of the sensitizing agent and the electron-donating colorless dye or the electron accepting compound may be previously formed and then dispersed. After dispersion, these dispersions are mixed. Conventional additives, such as a pigment, a surfactant, a binder, metallic soap, wax, an antioxidant, an ultraviolet light absorber, etc. may be optionally added to form a coating solution for the heat-sensitive layer. The resulting coating solution is coated on a support such as a high quality paper (or a high quality paper having an undercoat layer), a synthetic paper or a plastic film, and the coated support is then calendared to smooth it, thus obtaining the desired heat-sensitive recording material. It is preferred from the viewpoint of dot reproducibility that a support having a smoothness of at least 500 sec, particularly at least 800 sec according to JIS-8119, is used. The support having a smoothness of at least 500 sec can be obtained (1) by using a material having a high smoothness such as synthetic paper or a plastic film, (2) by providing an undercoat layer mainly composed of a pigment on a support, or (3) by supercalendering a support to improve the smoothness.

Compounds which have a solubility of at least 5 wt. % in water at 25° C. are preferred as binders. Examples of suitable binders include polyvinyl alcohol (including modified polyvinyl alcohols such as carboxy-modified, itaconic acid-modified, maleic acid-modified and silica-modified polyvinyl alcohols), methyl cellulose, carboxymethyl cellulose, starch (including modified starch), gelatin, gum arabic, casein, a hydrolyzate of a styrenemaleic anhydride copolymer, polyacrylamide and a saponified product of a vinyl acetate-polyacrylic acid copolymer. These binders can be used not only during dispersion but also for the purpose of improving the strength of the layer. For this purpose, latex binders of synthetic polymeric materials such as a styrene-butadiene copolymer, vinyl acetate copolymers, an acrylonitrile-butadiene copolymer, a methyl acrylate-butadiene copolymer and polyvinylidene chloride may be used together with the above-described binders. If desired, appropriate cross-linking agents for the binders may be added according to the types of the binders.

Examples of suitable pigments include calcium carbonate, barium sulfate, lithopone, agalmatolite, kaolin, silica and amorphous silica.

Examples of suitable metallic soaps include metal salts of higher fatty acids such as zinc stearate, calcium stearate and aluminum stearate.

If desired, other conventional additives such as surfactant, antistatic agent, ultraviolet light absorber, antifoaming agent, electrically conductive agent, fluorescent dye and colored dye may be optionally added.

The coated heat-sensitive recording material is dried, calendered and then is ready for use. Further, a protective layer may be provided on the heat-sensitive color forming layer, if necessary. Any protective layer conventionally used for heat-sensitive recording materials can be used in the present invention. Furthermore, a back coat layer may be provided on the opposite side of the support to the heat-sensitive color forming layer of the heat-sensitive recording material. Any back coat layer conventionally used for heat-sensitive recording materials can be used in the present invention.

The present invention is now illustrated in greater detail by reference to the following examples which, however, are not to be construed as limiting the present invention in any way.

EXAMPLES 1 to 7

Each of 20 g of 2-anilino-3-methyl-6-N-ethyl-N-tetrahydrofurfurylfluoran as the electron-donating colorless dye, 20 g of a bisthiourea compound as indicated in Table 1 as the electron-accepting compound, and 20 g of di(p-methylbenzyl)oxalate as the sensitizing agent was separately dispersed in 100 g of a 5% aqueous solution of polyvinyl alcohol (Kuraray PVA-105) in a ball mill overnight so as to form dispersions having an average particle size of not larger than 1.5 μm. Separately, 80 g of calcium carbonate was dispersed in 160 g of a 0.5% solution of sodium hexametaphosphate in a homogenizer to obtain a pigment dispersion. The thus-prepared dispersions for each of Examples 1 to 7 were mixed in such a proportion that the electron-donating colorless dye dispersion was 5 g, the electron-accepting compound dispersion was 10 g, the di(p-methylbenzyl) oxalate dispersion was 10 g and the calcium carbonate dispersion was 5 g. Further, 3 g of a 21% zinc stearate emulsion was added to each of the dispersions used to make Examples 1 to 7 to obtain a coating solution for the heat-sensitive color forming layer. The coating solution for the heat-sensitive color forming layer was coated on a high quality paper support having a basis weight of 50 g/m$^2$ in such an amount to obtain 5 g/m$^2$ of the color forming layer on a dry basis. The coating was carried out by means of a wire bar coater. The coated support was dried at 50° C. for one minute to obtain a heat-sensitive recording paper.

COMPARATIVE EXAMPLES 1 to 6

The procedure of Examples 1 to 7 was repeated except that each of N,N'-diphenylthiourea, N-phenyl-N'-benzylthiourea,N-phenyl-N'-(o-methylphenyl)thiourea,N,N'-diphenylurea, N-phenyl-N'-benzylurea and bisphenol A was used in place of the bisthiourea compound as the electron-accepting compound to prepare each of coating solutions for the heat-sensitive color forming layer.

The surface of each of the thus-obtained heat-sensitive recording papers in the Examples and comparative Examples was calendered to give a smoothness of 300±50 sec in terms of Beck smoothness, thus obtaining each of heat-sensitive recording materials.

A chemical resistance test of the heat-sensitive recording papers was carried out in the following manner. Filter paper was impregnated with each of ethanol and a plasticizer (dioctyl phthalate) and then placed upon an area of the recording paper where a color was formed by conducting printing with a printing energy of 30 mJ/mm$^2$ by a printing tester manufactured by Kyocera Corporation. After 48 hours, the degree of fog and the degree of decoloration (discoloration and fading) in the color formed area were evaluated. The results are shown in Table 1.

TABLE 1

| | Electron-accepting Compound | Ethanol | | Plasticizer | |
|---|---|---|---|---|---|
| | | Fog | Decoloration | Fog | Decoloration |
| Example 1 | Compound 24 | ○ | ◎ | ◎ | ○ |
| Example 2 | Compound 25 | ○ | ◎ | ○ | ○ |
| Example 3 | Compound 11 | ○ | ○ | ○ | ○ |
| Example 4 | Compound 14 | ○ | ○ | ○ | ○ |
| Example 5 | Compound 12 | ○ | ○ | ○ | ○ |
| Example 6 | Compound 21 | ○ | ○ | Δ | ○ |
| Example 7 | Compound 15 | ○ | ○ | Δ | ○ |
| Comp. Ex. 1 | N,N'-diphenylthiourea | ○ | Δ | ○ | X |
| Comp. Ex. 2 | N-phenyl-N'-benzylthiourea | ○ | Δ | ○ | X |
| Comp. Ex. 3 | N-phenyl-N'-(o-methylphenyl)-thiourea | ○ | Δ | ○ | X |
| Comp. Ex. 4 | N,N'-diphenylurea | ○ | Δ | ○ | X |
| Comp. Ex. 5 | N-phenyl-N'-benzylurea | ○ | Δ | ○ | X |
| Comp. Ex. 6 | bisphenol A | X | X | X | X |

◎: very excellent
○: excellent (A slight change was found).
Δ: practically usable (Image could be read).
X: not usable (Image could only be read with great difficultly).

It is apparent from the results of Table 1 that the recording materials of the present invention cause neither fogging nor decoloration in the color formed area by reagents and exhibit very excellent overall performance.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having thereon a heat-sensitive color forming layer comprising an electron-donating colorless dye and an electron-accepting compound, wherein said electron-accepting compound is a bisthiourea compound represented by formula (1):

$$R_1-NH-\underset{\underset{S}{\|}}{C}-NH-X-NH-\underset{\underset{S}{\|}}{C}-NH-R_2 \quad (1)$$

wherein $R_1$ and $R_2$ each independently represents a substituted or unsubstituted $C_1$ to $C_{12}$ alkyl group or a substituted or unsubstituted $C_6$ to $C_{10}$ aryl group; and X represents a $C_2$ to $C_{18}$ alkylene group or a $C_2$ to $C_{18}$ aralkylene group.

2. The heat-sensitive recording material as claimed in claim 1, wherein said bisthiourea compound is represented by formula (2):

$$R_3-NH-\underset{\underset{S}{\|}}{C}-NH-X-NH-\underset{\underset{S}{\|}}{C}-NH-R_4 \quad (2)$$

wherein $R_3$ and $R_4$ each independently represents a substituted or unsubstituted $C_6$ to $C_{10}$ aryl group; and X represents a $C_2$ to $C_{18}$ alkylene group or a $C_2$ to $C_{18}$ aralkylene group.

3. The heat-sensitive recording material as claimed in claim 2, wherein the aryl group contains at least one substituent selected from the group consisting of an alkyl group, an alkoxy group, a halogen atom, a trihalomethyl group, a cyano group, an acyl group an aryl group, an alkylsulfonyl group, and an arylsulfonyl group.

4. The heat-sensitive recording material as claimed in claim 1, wherein the alkyl group contains at least one substituent selected from the group consisting of an alkyl group, an alkoxy group, a halogen atom, a trihalomethyl group, a cyano group, an acyl group, an aryl group, an alkylsulfonyl group, and an arylsulfonyl group.

5. The heat-sensitive recording material as claimed in claim 1, wherein the aryl group contains at least one substituent selected from the group consisting of an alkyl group, an alkoxy group, a halogen atom, a trihalomethyl group, a cyano group, an acyl group an aryl group, an alkylsulfonyl group, and an arylsulfonyl group.

6. The heat-sensitive recording material as claimed in claim 1, wherein said bisthiourea compound is present in the color forming layer together with another electron-accepting compound.

7. The heat-sensitive recording material as claimed in claim 1, wherein the color forming layer further contains a sensitizing agent.

* * * * *